US005452713A

United States Patent [19]

Vipond et al.

[11] Patent Number: 5,452,713

[45] Date of Patent: Sep. 26, 1995

[54] PORTABLE VENTILATOR WITH REVERSIBLE INLET FITTING

[75] Inventors: Edward W. Vipond, Gardner; Robert W. Shaffer, II, East Templeton, both of Mass.

[73] Assignee: Tuthill Corporation, Millbury, Mass.

[21] Appl. No.: 329,946

[22] Filed: Oct. 24, 1994

[51] Int. Cl.[6] ..... A61M 16/00

[52] U.S. Cl. ..... 128/204.18; 128/202.27; 128/204.25

[58] Field of Search ..... 128/200.24, 202.27, 128/204.18, 204.24, 204.25, 204.29, 205.11, 912; 417/225, 226, 238, 572; 604/266, 902; 15/1, 414, 415.1, 416, 417, 418, 246.2; 406/152

[56] References Cited

U.S. PATENT DOCUMENTS

| | | | |
|---|---|---|---|
| 4,080,103 | 3/1978 | Bird | 128/204.18 X |
| 4,211,221 | 7/1980 | Schwanbon et al. | 128/204.26 |
| 5,002,050 | 3/1991 | McGinnis | 128/204.18 |
| 5,044,362 | 9/1991 | Younes | 128/204.21 |
| 5,385,140 | 1/1995 | Smith | 128/200.23 |

FOREIGN PATENT DOCUMENTS

| | | | |
|---|---|---|---|
| 452111 | 8/1936 | United Kingdom | 15/415.1 |
| 2118625 | 11/1983 | United Kingdom | 128/204.18 |
| 90/14121 | 11/1990 | WIPO | 128/204.21 |

*Primary Examiner*—Kimberly L. Asher
*Assistant Examiner*—Eric P. Raciti
*Attorney, Agent, or Firm*—Samuels, Gauthier & Stevens

[57] ABSTRACT

A portable ventilator having axially aligned inlet and outlet ports, an inlet fitting adapted for alternative connection to the inlet port in either of two 180° reverse orientations. In one such orientation, the inlet fitting enhances air flow into the ventilator, and in the other such orientation, the inlet fitting adapts the inlet port for connection to a suction duct or the like.

5 Claims, 4 Drawing Sheets

PORTABLE VENTILATOR WITH REVERSIBLE INLET FITTING

BACKGROUND OF THE INVENTION

1. Field of the Invention

This invention relates to portable ventilators, and is concerned in particular with axial flow motor-driven fans.

2. Description of the Prior Art

Conventionally, portable ventilators of the type under consideration have relatively compact housings with axially aligned inlet and outlet ports. Motor-driven fans serve to forcibly drive air through the housings via the inlet and outlet ports.

Traditionally, the outlet port is adapted for connection to a flexible delivery duct or the like, and the inlet port is configured differently to enhance the efficiency of air flow into the housing. If a customer should require a different arrangement, where for example the inlet port is also adapted for connection to a duct, then the housing must be reconfigured, usually requiring a special order, with attendant delivery delays and cost increases.

SUMMARY OF THE INVENTION

The present invention avoids the above described drawbacks by providing a specially designed inlet fitting which can be employed in one of two reversible orientations. In a first orientation, the inlet firing coacts with the conventional inlet port to enhance air flow into the housing, whereas in the second orientation, the inlet fitting adapts the inlet port for connection to a suction duct or the like. The inlet fitting is easily detached from and reassembled to the housing, and does not adversely affect portability of the overall combination.

These and other objects and advantages will become more apparent as the description proceeds with reference to the accompanying drawings, wherein:

DETAILED DESCRIPTION OF THE ILLUSTRATED EMBODIMENTS

Figure 1:
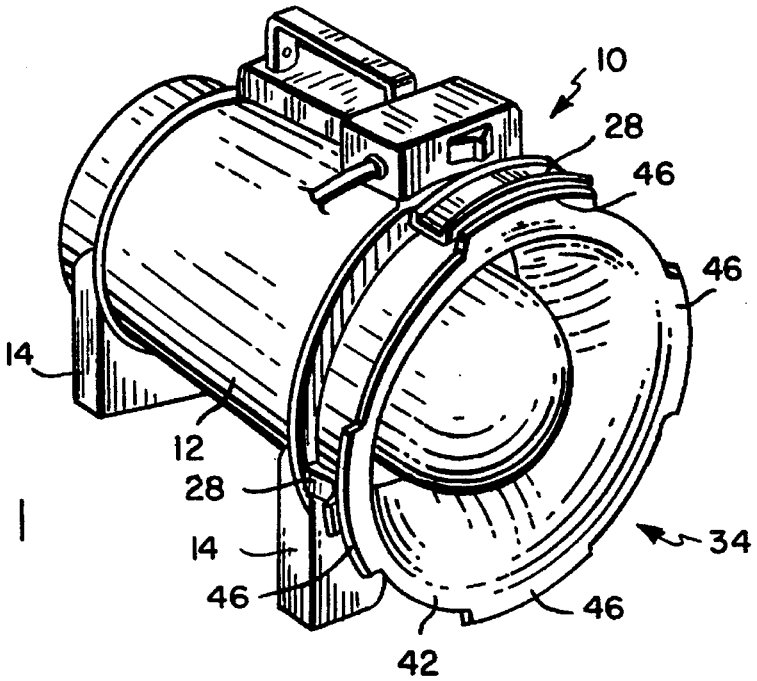
FIG. 1 is a perspective view of a portable ventilator embodying the concepts of the present invention.
Figure 3:
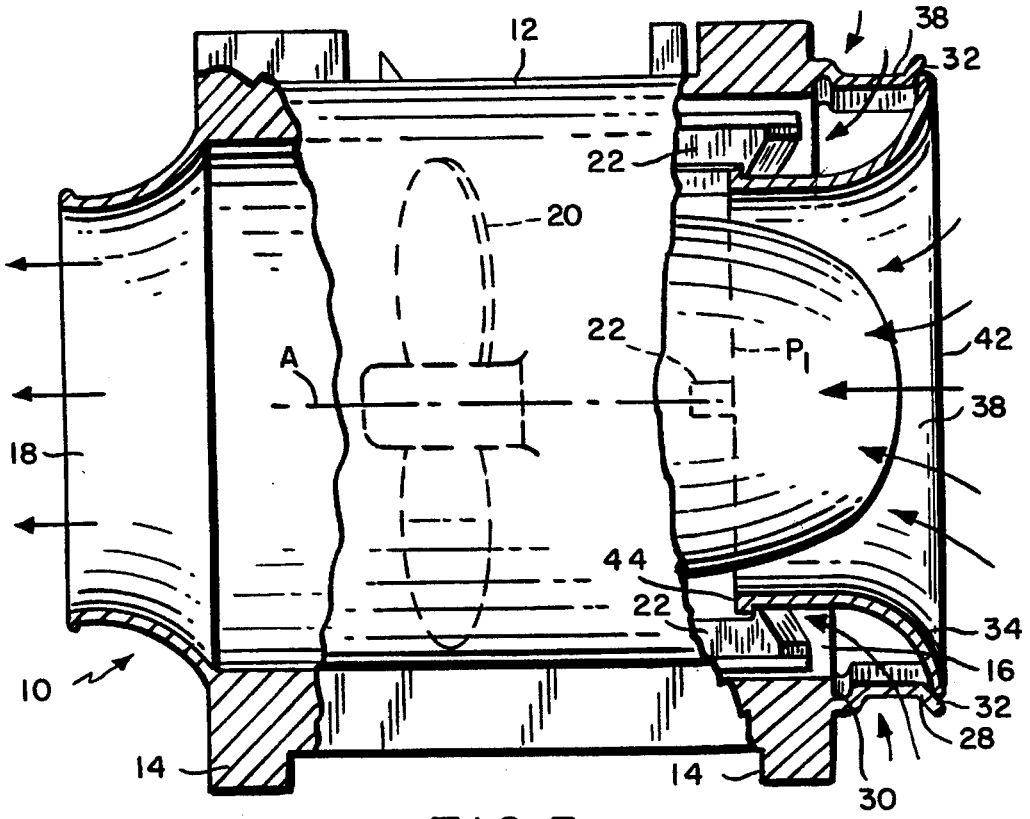
FIG. 3 is a diagrammatic longitudinal sectional view through the ventilator showing the inlet fitting in a first orientation adapted to enhance air flow into the housing.
Figure 4:
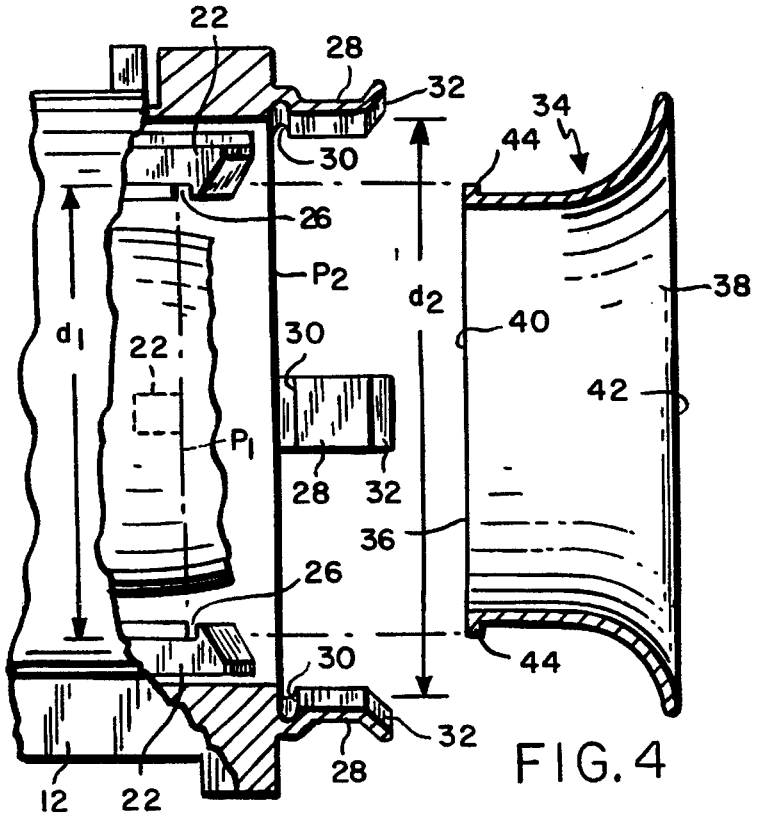
FIG. 4 is a partial sectional view similar to FIG. 3 but showing the inlet fitting removed from the housing.

Referring initially to FIGS. 1, 3 and 4, a portable ventilator is shown at 10 comprising a compact generally cylindrical housing 12 supported horizontally on legs 14. The housing has axially aligned inlet and outlet ports 16, 18, and contains a fan 20 mounted for rotation about the axis "A" of the housing and driven by a motor (not shown). The fan operates in a generally conventional manner to forcibly drive air through the housing via the inlet and outlet ports.

The housing is internally provided with a plurality of circumferentially spaced first ribs 22 extending in parallel with axis A. The ribs 22 define first abutments lying in a first reference plane $P_1$ around a first circle having a diameter $d_1$ (shown in FIG. 4). Some of the ribs 22 additionally define undercut first grooves 26.

The housing 12 is additionally provided with externally protruding circumferentially spaced second ribs 28 projecting from a second abutment lying in a second reference plane $P_2$ and extending around a second circle having a diameter $d_2$ (shown in FIG. 4) which is greater than the diameter $d_1$. At least some of the second ribs 28 define undercut second grooves 30, and are provided with flared contact surfaces 32. The first reference plane $P_1$ and the first ribs 22 are axially spaced inwardly with respect to the second reference plane $P_2$ and the second ribs 28.

Figure 2:
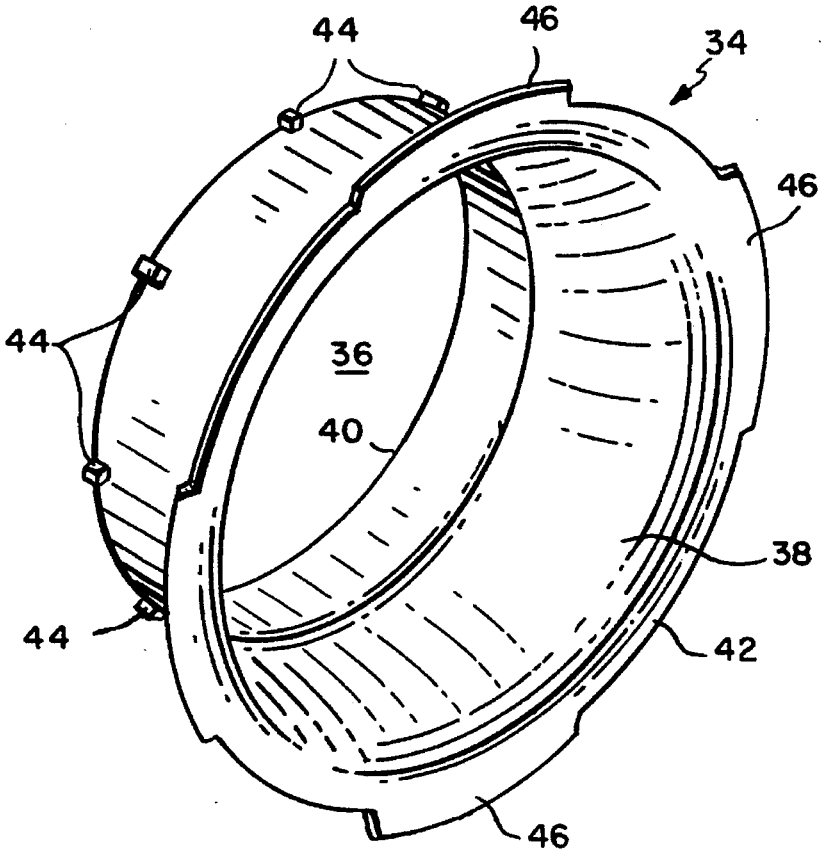
FIG. 2 is a perspective view of the inlet fitting.

With additional reference to FIG. 2, will be seen that a generally cylindrical inlet fitting 34 has a curved wall extending between first and second axially aligned openings 36, 38 surrounded respectively by first and second circular rims 40, 42. The diameter of the first rim 40 is equal to the diameter $d_1$, and the diameter of the second rim is likewise equal to the diameter $d_2$.

The first rim 40 has a plurality of integrally formed radially outwardly protruding first tabs 44, and the second rim 42 is similarly provided with somewhat larger second tabs 46.

Figure 7A:
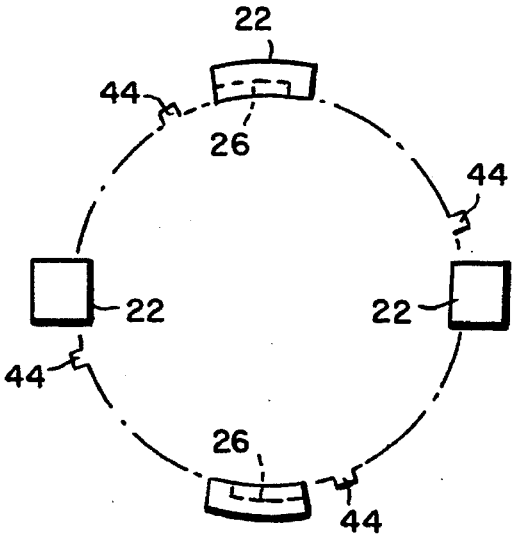
FIGS. 7A, 7B and 8A, 8B are schematic illustrations depicting the coupling arrangements employed to connect the inlet fitting to the housing.
Figure 7B:
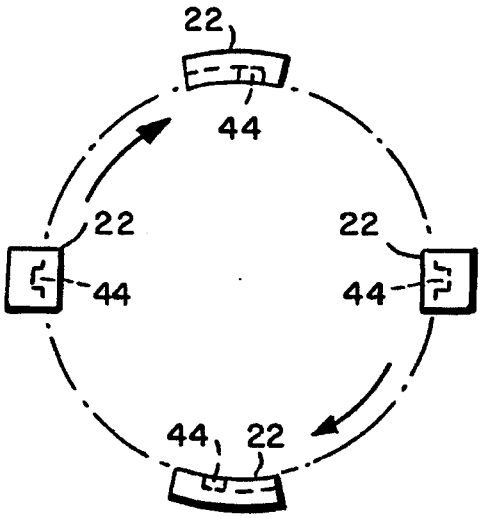

When oriented in a first position, as shown for example in FIGS. 1 and 3, the first rim 40 is inserted axially into the inlet port 16 of the housing 12, and placed against the first abutments defined by the first ribs 22. At this intermediate juncture, as depicted diagrammatically in FIG. 7A, the first tabs 44 are offset angularly with respect to the first ribs 22. Then, by rotating the fitting in a clockwise direction, as depicted in FIG. 7B, at least some of the tabs 44 are located in the undercut first grooves 26 defined by some of the ribs 22, thereby establishing a bayonet-type mechanical interlock which securely retains the inlet fitting in its inserted position in the housing. Additional support for the fitting is provided by the flared contact surfaces 32 of the second ribs 28 which bear against and serve to radially confine the outer protruding portion of the fitting.

When thus oriented, the inlet fitting 34 serves to enhance air flow into the housing, thereby promoting operational efficiencies. The inlet fitting may be removed by simply reversing the assembly procedure.

Figure 5:
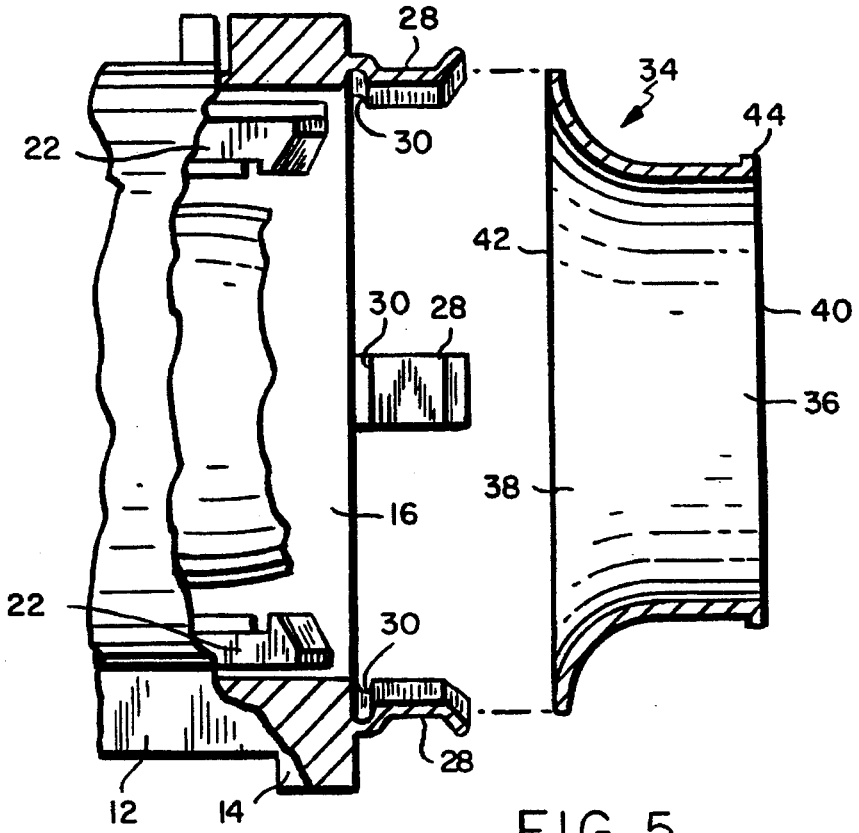
FIG. 5 is a partial sectional view showing the inlet fitting removed from the housing but reversed 180° from its orientation as shown in FIGS. 1 and 3.
Figure 6:
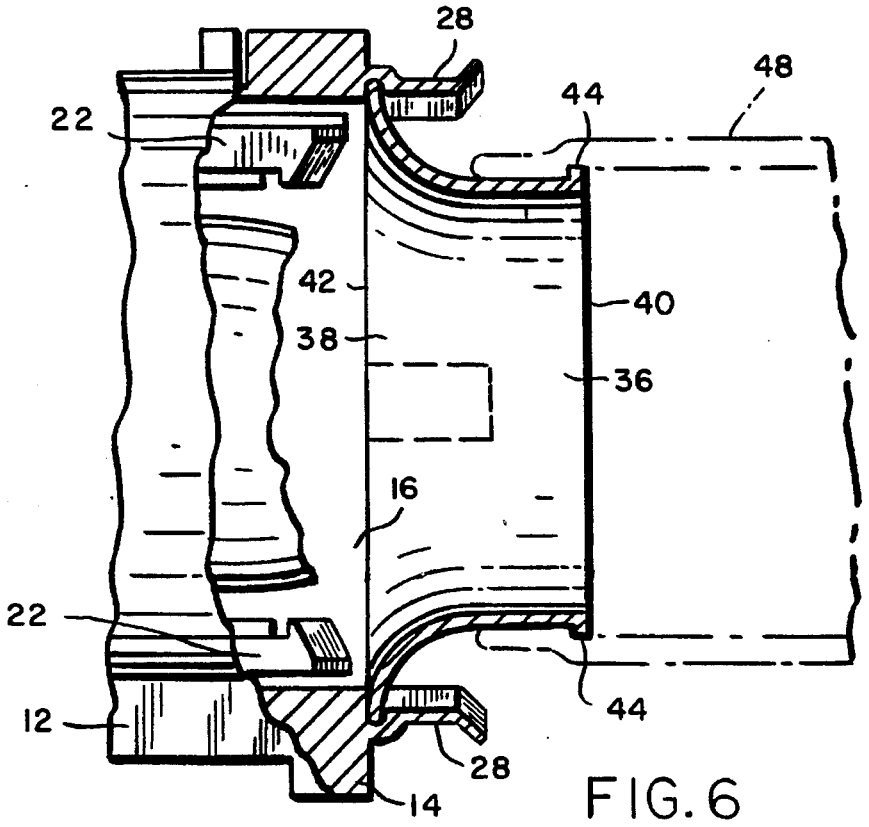
FIG. 6 is a view similar to FIG. 5 showing the inlet fitting assembled to the housing in a manner which adapts the inlet port for communication with a suction duct.
Figure 8A:
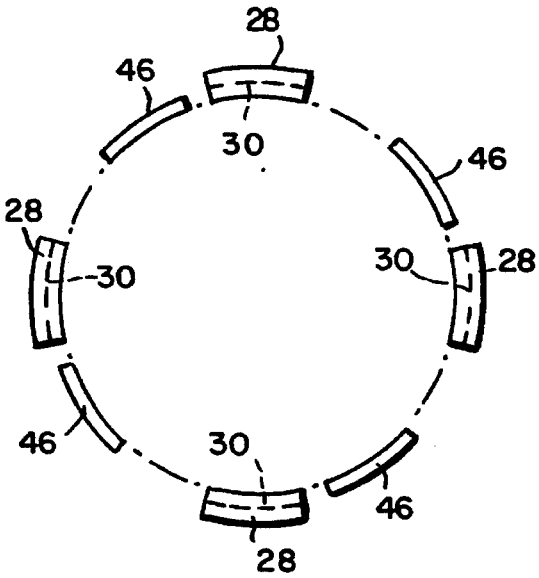
Figure 8B:
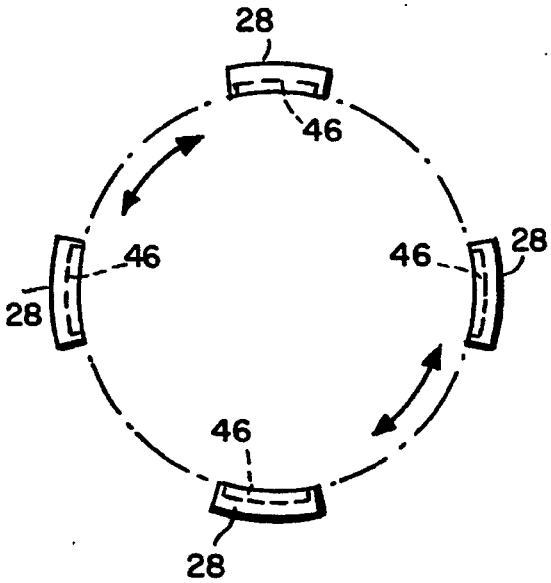

The inlet fitting may be reverse oriented by 180° for assembly as shown in FIGS. 5 and 6. In so doing, the second rim 42 is inserted axially into the inlet port against the second abutments defined by the second ribs 28. At this intermediate juncture, as depicted diagrammatically in FIG. 8A, the second tabs 46 are offset angularly with respect to the second ribs 28. By rotating the fitting in either direction, as depicted in FIG. 8B, the tabs 46 are located in the undercut second grooves 30, thus again establishing a secure bayonet-type interlock. The inlet fitting may thus serve as a connection for an inlet duct, as indicated at 48 by the broken lines in FIG. 6.

In light of the foregoing, it will now be appreciated by those skilled in the art that by employing an inlet fitting as herein described and illustrated, a portable ventilator is provided with a degree of universality not heretofore available with conventional designs. By simply reverse orienting the inlet fitting, the inlet port of the housing can be adapted either for conventional entrainment of ambient air, or suction through a duct. The inlet fitting may comprise a plastic moulding, with a light weight yet rugged design which does not impair portability, and which contributes only marginally to the overall cost of the combination.

We claim:

1. A portable ventilator comprising:

a housing with axially aligned inlet and outlet ports;

a rotatably driven fan arranged in said housing, said fan being operable to forcibly drive air through said housing via said inlet and outlet ports;

first and second abutments lying respectively on first and second reference planes located adjacent to said inlet port, said first reference plane being axially spaced inwardly from said second reference plane;

a cylindrical inlet fitting having first and second axially aligned openings surrounded respectively by circular first and second rims;

first coupling means for detachably connecting said inlet fitting to said housing in a first orientation with said first rim in face-to-face engagement with said first abutment; and second coupling means for detachably connecting said inlet fitting to said housing in a 180° reversed second orientation with said second rim in face-to-face engagement with said second abutment.

2. The portable ventilator of claim 1 wherein said first and second abutments are arranged respectively on first and second circles, said first circle having a diameter smaller than that of said second circle, said first rim having a diameter equal to that of said first circle and said second rim having a diameter equal to that of said second circle.

3. The portable ventilator of claim 2 wherein said first coupling means comprises circumferentially spaced first ribs projecting axially from said first abutment and defining undercut first grooves, and circumferentially spaced first tabs on said first rim configured and dimensioned to coact in a rotatable bayonet interlock with said undercut first grooves.

4. The portable ventilator in accordance with claim 2 wherein said second coupling means comprises circumferentially spaced second ribs projecting axially from said second abutment and defining undercut second grooves, and circumferentially spaced second tabs on said second rim configured and dimensioned to coact in a rotatable bayonet interlock with said undercut second grooves.

5. The portable ventilator as claimed in claim 4 wherein said inlet fitting is confined within and radially supported by said second ribs when connected in said first orientation.

* * * * *